US005704380A

United States Patent [19]

Zelniker et al.

[11] Patent Number: 5,704,380

[45] Date of Patent: Jan. 6, 1998

[54] DISHWASHING MACHINE

[75] Inventors: David Zelniker; Abraham Kafzan, both of Tel-Aviv, Israel

[73] Assignee: Deeay Technologies, Ltd., Tel-Aviv, Israel

[21] Appl. No.: 397,673

[22] Filed: Mar. 2, 1995

[30] Foreign Application Priority Data

Mar. 4, 1994 [IL] Israel ..... 108864
Dec. 5, 1994 [IL] Israel ..... 111876

[51] Int. Cl.[6] ..... B08B 3/02

[52] U.S. Cl. ..... 134/95.3; 134/98.1; 134/153; 134/157; 239/551

[58] Field of Search ..... 134/176, 179, 134/72, 153, 157, 200, 94.1, 99.1, 99.2, 80, 48, 95.3, 98.1, 56 D, 57 D, 58 D; 222/81, 88; 239/549, 550, 551, 562, 503

[56] References Cited

U.S. PATENT DOCUMENTS

| | | | |
|---|---|---|---|
| 1,147,164 | 7/1915 | Haggerty et al. | 134/48 |
| 1,223,380 | 4/1917 | Cochrane | 134/176 |
| 1,332,712 | 3/1920 | Couch | 134/80 |
| 1,433,337 | 10/1922 | Boesser . | |
| 1,512,918 | 10/1924 | Forsgard | 134/48 |
| 1,520,110 | 12/1924 | Blakeslee | 134/80 |
| 1,581,134 | 4/1926 | Merseles | 134/95.3 |
| 1,980,065 | 11/1934 | Johnston | 239/549 |
| 2,038,260 | 4/1936 | Ash | 134/176 |
| 2,189,451 | 2/1940 | Peters | 134/48 |
| 2,443,091 | 6/1948 | Zademach | 134/80 |
| 2,558,818 | 7/1951 | Campbell | 134/48 |
| 2,574,069 | 11/1951 | Stanley et al. . | |
| 2,598,074 | 5/1952 | Sadwith | 134/95.3 |
| 2,643,659 | 6/1953 | Auten . | |
| 2,704,082 | 3/1955 | Jackson | 134/95.3 |
| 2,953,144 | 9/1960 | Kaphengst . | |
| 2,992,779 | 7/1961 | James et al. | 239/551 |
| 3,094,997 | 6/1963 | Nolte et al. | 134/48 |
| 3,267,944 | 8/1966 | Meeker et al. | 239/551 |
| 3,543,844 | 12/1970 | Sobel . | |
| 3,886,958 | 6/1975 | Diebel et al. | 134/80 |
| 3,942,545 | 3/1976 | Flynn | 134/80 |
| 4,277,290 | 7/1981 | Andrews et al. | 134/56 D |
| 4,420,003 | 12/1983 | Lee et al. | 134/80 |
| 4,535,795 | 8/1985 | Taylor | 134/95.3 |
| 4,825,887 | 5/1989 | Nezworski | 134/183 |
| 5,086,950 | 2/1992 | Crossvale et al. | 222/88 |
| 5,131,419 | 7/1992 | Roberts | 134/57 D |
| 5,222,530 | 6/1993 | Baker et al. | 222/88 X |
| 5,337,922 | 8/1994 | Salkelo et al. | 222/88 X |
| 5,351,859 | 10/1994 | Jansen | 222/88 X |
| 5,413,130 | 5/1995 | Maruyama et al. | 134/95.3 |

FOREIGN PATENT DOCUMENTS

| | | | |
|---|---|---|---|
| 459358 | 1/1937 | United Kingdom | 134/176 |
| 2036548 | 7/1980 | United Kingdom . | |

*Primary Examiner*—Frankie L. Stinson
*Attorney, Agent, or Firm*—Gary M. Nath, Esq.; Nath & Associates

[57] ABSTRACT

A dishwashing machine is provided for washing dishes with a very rapid washing cycle in which water and detergent are sprayed through different spraying nozzles in different operational stages within the dishwashing cycle.

12 Claims, 6 Drawing Sheets

DISHWASHING MACHINE

FIELD OF THE INVENTION

The present invention relates to dishwashing machines. More specifically the invention relates to dishwashing machines of a kind intended for washing a small number of dishes, e.g. glasses, intended to be used in offices, or the like.

BACKGROUND OF THE INVENTION

Several types of dishwashing machines were hitherto known and widely used. One type of dishwashing machine is a powerful large volume multipurpose dishwashing machine for use in places where large volumes of dishes have to be cleaned. A typical machine of this type comprises a conveyor for transporting dirty dishes through a washing chamber where a stationary system of jets sprinkles detergent and water onto the dishes in predetermined zones of the chamber. Dishes are placed on one end of the conveyor and after the dishes pass through the chamber they are removed at its other end.

Another known type of dishwashing machine is of a middle to small size and is intended for home use and has a tray for placing dishes thereon, and with a system of nozzles installed inside the machine for injection of detergents and water to a washing chamber. The user loads dirty dishes into the tray and then following a washing cycle, which typically lasts for ½–1½ hours, the tray with the clean dishes can be removed from the machine.

A further known type of washing machine is a compact machine with a continuous load-unload carousel tray system. Such a machine is intended particularly for rapid cleaning of glasses and comprises a circular rotatable basket divided by a sealing partition into two compartments so as to enable the user to load one half of the basket with dirty glasses while the dishes held on the other half of the basket are within the chamber undergoing washing. The washing cycle typically involves pumping of a solution from a mixing chamber which depending on the operational cycle stage is filled with a detergent, a mixture of detergent and water or only water alone. In such a machine, water and detergent are injected in succession, depending on the operational cycle throughout the same nozzle system. Thus, rinsing water, when being pumped through the nozzles following the previous stage of injection of detergents, is not sufficiently pure in that it carries a residual amount of detergent solution and it is thus necessary to flush the washing machine with relatively large amounts of water. The washing cycle in such a dishwashing machine typically lasts several minutes.

In the following description and claims the term "dishwashing machine" will be used in a general sense even when the machine concerned serves also or even mainly for washing glasses.

It is an object of the invention to provide a dishwashing machine, particularly such adapted to rapidly wash dishes, typically glasses.

It is another object of the invention to provide a replaceable detergent container for said washing machine.

GENERAL DESCRIPTION OF THE INVENTION

By one aspect of the present invention, there is provided a dishwashing machine which comprises a dishwashing chamber, means for holding dishes within said chamber, and a dishwashing assembly for washing dishes held within in said chamber; the dishwashing machine has an operational cycle comprising steps of (a) spraying water on the dishes and (b) spraying detergent on the dishes; said assembly comprises at least two liquid spraying sub-assemblies, of which at least one is a detergent spraying sub-assembly and at least one other is a water spraying sub-assembly; each sub-assembly comprises a plurality of spray nozzles, one or more liquid ducts leading from a liquid reservoir to the nozzles, and means allowing for rapid activation and inactivation of the spraying of liquid throughout the nozzles; the nozzles of each sub-assembly being arranged so that their combined spraying will apply liquid on substantially all faces of the dishes, the nozzles being either (i) stationary within a zone of said chamber, the nozzles of all sub-assemblies being within the same zone of the chamber, wherein the dish holding means being adapted to pass dishes through said zone at each of the steps of the operational cycle, (ii) stationary and spatiallyh distributed within said chamber so as to apply their liquid simultaneously on all dishes held on the dish holding means within the chamber, or (iii) being held on one or more arms moveable within the chamber, each such arm holding nozzles of all sub-assemblies, the arm being adapted to pass throughout the chamber at each step of the operational cycle.

In accordance with one embodiment of the invention, all nozzles are situated within a zone of said chamber and said means for holding dishes are adapted for movement within the chamber, whereby the dishes pass through said zone at each step of the cycle.

In accordance with another, preferred embodiment of the invention, all nozzles are held on one or more moveable arms adapted for movement within said chamber at each step of the operational cycle, whereby all dishes held within chamber are sprayed by the liquid sprayed at the respective step.

In accordance with a further embodiment of the invention, the nozzles of all sub-assemblies are stationary and spatially distributed within the chamber.

According to an embodiment of the invention, the means for holding dishes comprise a loading-unloading rotatable tray divided by a vertical water impermeable partition into a pair of identical portions; the tray being positioned such that when one of the identical portions is within the dishwashing chamber, the other of said portions is outside said chamber and by rotation of the tray the positions of the portions are replaced with one another; said partition being capable of water-tight engagement with adjacent wall portions of the dishwashing chamber.

When one of said portions is within the chamber, the dishes held thereon are washed by the dishwashing machine and dishes can then be loaded or unloaded on the other of said portions.

In accordance with the above preferred embodiment, the washing assembly typically comprises one or two rotatable nozzles'-carrying arms. Where the means for holding dishes are the above rotatable tray, the rotation of said arms is typically co-axial with the tray.

A dishwashing machine in accordance with the above preferred embodiment may comprise either a single nozzles'-carrying arm, e.g. a rotatable L-shaped arm comprising a horizontal leg below the dish holding means and a vertical leg extending above the upper faces of the dishes, there being nozzles on the horizontal leg adapted for spraying liquid upwards onto the lower face of the dishes and the vertical leg carrying nozzles adapted for spraying liquid sideways and/or downwards with a slant, for spraying liquid on the upper faces of the dishes. Alternatively, rather than having a single arm, the dishwashing machine of the invention may have two moveable arms, moving in parallel within the chamber, one below the dishes and one above.

The dishwashing assembly preferably comprises three liquid spraying sub-assemblies, of which one is a water spraying sub-assembly and two are detergent spraying sub-assemblies. Of the two detergent spraying sub-assemblies, one is for spraying of a cleaning detergent and the other for spraying of a detergent intended to give a shiny appearance to the washed dishes (hereinafter: "shining detergent"). The operational cycle of a dishwashing machine in accordance with this embodiment may have five steps as follows:

(a) spraying of water by the water spraying sub-assembly;

(b) spraying of a cleaning detergent by one of the detergent spraying sub-assemblies;

(c) spraying water by the water spraying sub-assembly;

(d) spraying a shiny detergent by the other detergent spraying sub-assembly; and (e) spraying water by the water spraying sub-assembly.

The water for the water spraying sub-assembly is typically supplied from an external water supply line. The water spraying sub-assembly thus comprises a valve, usually electrically activated, which controls the spraying of water through the nozzles of this sub-assembly.

Each of the detergent spraying sub-assemblies comprises a detergent reservoir and a pump adapted to draw detergent from the reservoir and supply it under pressure to the nozzles. The detergent reservoir may be an internal reservoir which is periodically filled by the appropriate detergent; or alternatively and preferably, the detergent reservoir may be a replaceable container. Such a replaceable container for use in a dishwashing machine of the invention constitutes an aspect of the present invention. Where the dishwashing machine uses two types of detergents, the replaceable container will typically comprise two compartments, each holding a different detergent.

The replaceable container comprises a detergent discharge opening which is adapted to cooperate with a detergent receiving assembly within a washing machine in a manner so that detergent is transferred without spill from the container to said assembly. Typically, the detergent receiving assembly comprises an elongated member having a lumen defining a liquid passageway leading from one or more apertures at its end portion to the detergent spring sub-assembly; the end portion being adapted for insertion through a cap fitted on the discharge opening so that said apertures come to lie within the said container.

By one embodiment, said elongated member has a sharpened end which is adapted to pierce a membrane in said cap.

In accordance with another, preferred embodiment, the cap has a central cylindrical recess with an opening at its end which is distal from the cap's external surface, the distal end being closed by a detachable closure which once detached can be reattached to said distal end thus re-closing the opening; and said elongated member being cylindrical at at least an end portion thereof with an external diameter essentially identical to the internal diameter of said cylindrical recess, and having a length to allow it to pass through said cylindrical recess so that its said one or more apertures come to lie within said container; an end portion of said elongated member being adapted for engagement with said closure; whereby once the opening of the container is fitted onto said detergent receiving assembly, said end portion engages with the closure which remains engaged with said end portion as long as the container and the detergent receiving assembly remain combined, and once the container is detached from the detergent receiving assembly, the closure is thereby pulled back to said opening and reattaches itself onto said distal end.

The invention will now be illustrated with reference to some specific embodiments depicted in the annexed drawings.

DETAILED DESCRIPTION OF THE INVENTION

Figure 1:
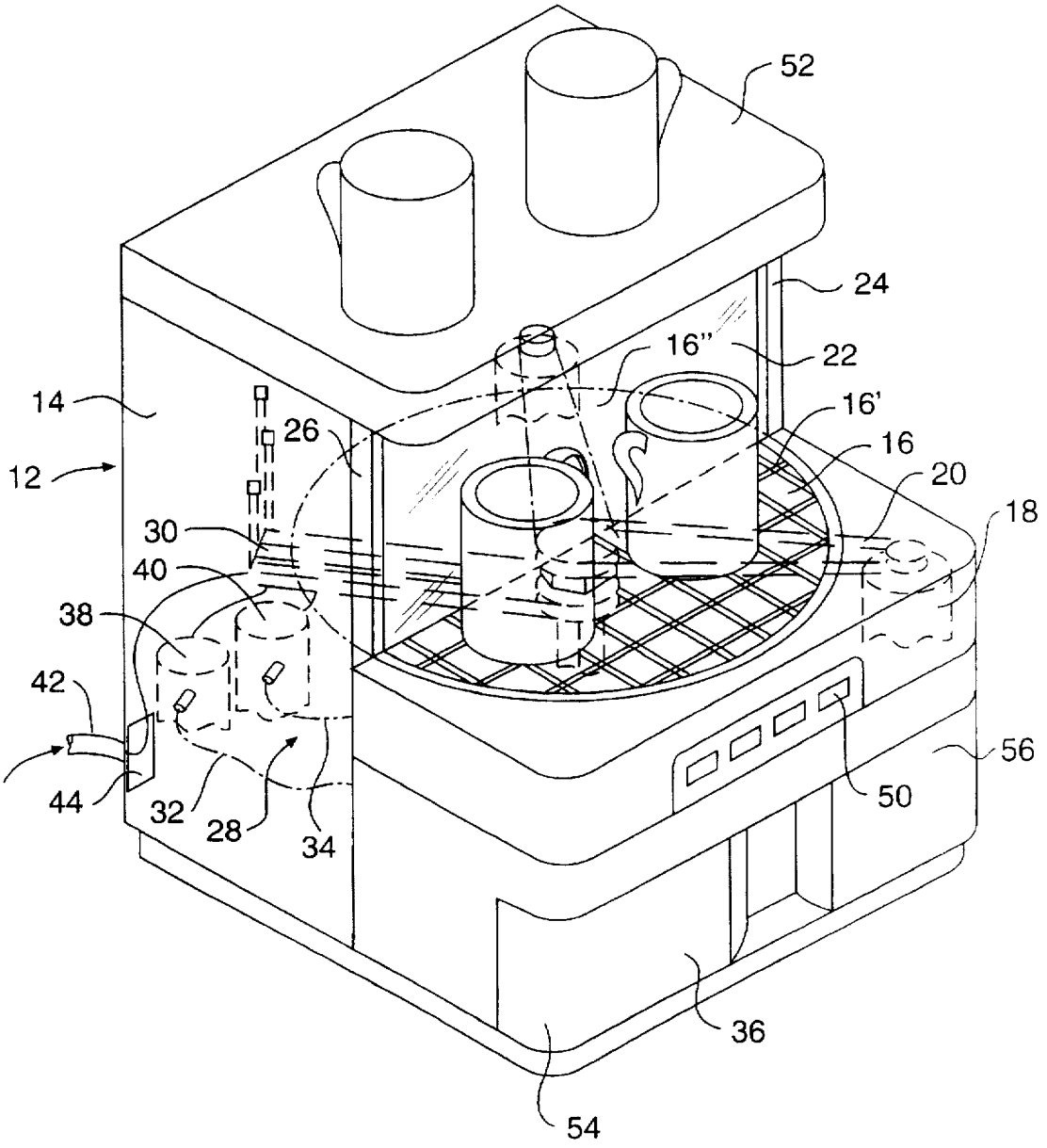
FIG. 1 shows a perspective view of a dishwashing machine in accordance with an embodiment of the invention showing also some internal components of the machine.
Figure 2:
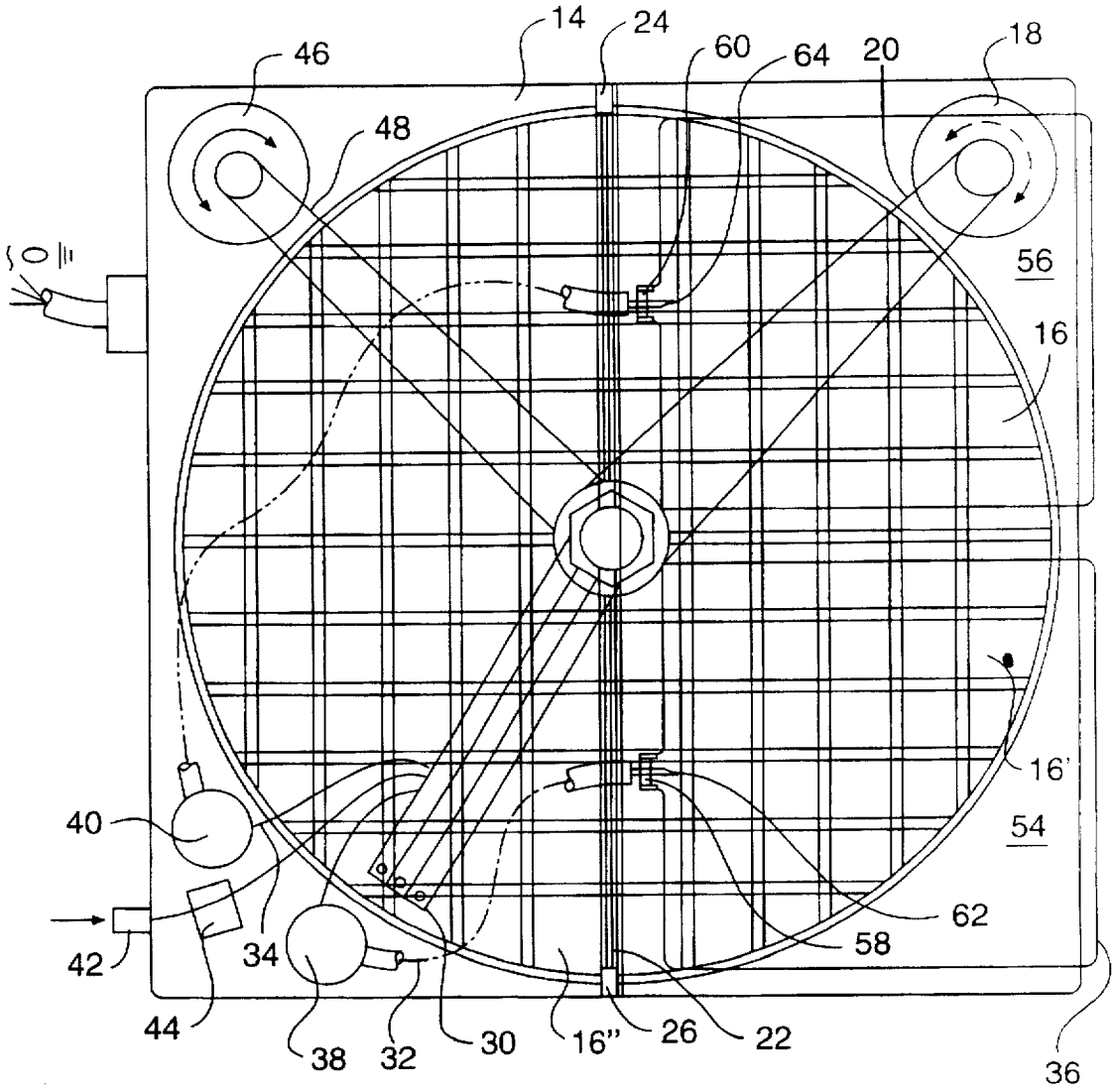
FIG. 2 shows a view from above with the upper wall removed.

Reference is first made to FIGS. 1 and 2 showing a dishwashing machine generally designated 12 which has a dishwashing compartment 14. A carousel tray 16, which is rotatable by means of motor 18 and transmission band 20 is divided by means of partition 22 into two semi-circular portions, 16' and 16". Once the former portion is outside chamber 14 the latter is within and vice versa. Partition 22 forms together with adjacent wall portions 24 and 26 an essentially watertight seal.

The dishwashing machine as shown in the drawings is particularly suitable for rapid washing of glasses. These, as shown in FIG. 1, are placed onto the portion of tray 16 which is outside chamber 14, (i.e. portion 16' in the position shown in FIGS. 1 and 2) and then the tray rotates whereby portions 16' and 16" change positions and consequently the glasses placed on the tray outside the chamber, come to be positioned within the chamber where they are washed.

Dishwashing machine 12 further has a dishwashing assembly within chamber 14 generally designated 28 which comprises an L-shaped arm 30 holding a plurality of nozzles belonging each to one of three liquid spraying sub-assemblies, two for spraying of a detergent and one for the spraying of water. The detergent spraying sub-assemblies comprise liquid ducts 32 and 34 leading each to a different detergent reservoir held within replaceable container 36, and pumps 38 and 40, respectively, for pumping the detergents to the nozzles. Water dispensing sub-assembly comprises a water duct 42 and an electrical control valve 44. Dishwashing assembly further comprises a motor 46 which is adapted, by the intermediary of transmission band 48, to rotate arm 30 to and fro within chamber 14.

The dishwasher machine further comprises a control consul 50 and an upper wall 52 adapted for holding of clean glasses.

Container 36, as shown in FIG. 2, has two compartments 54 and 56, each holding a different detergent. Each compartment has a respective opening 58 and 60 which is covered by a piercable cap which upon insertion is pierced by needles 62 and 64 whereupon the detergent contained in each of these compartments can be drawn by respective pumps 38 and 40.

Figure 3:
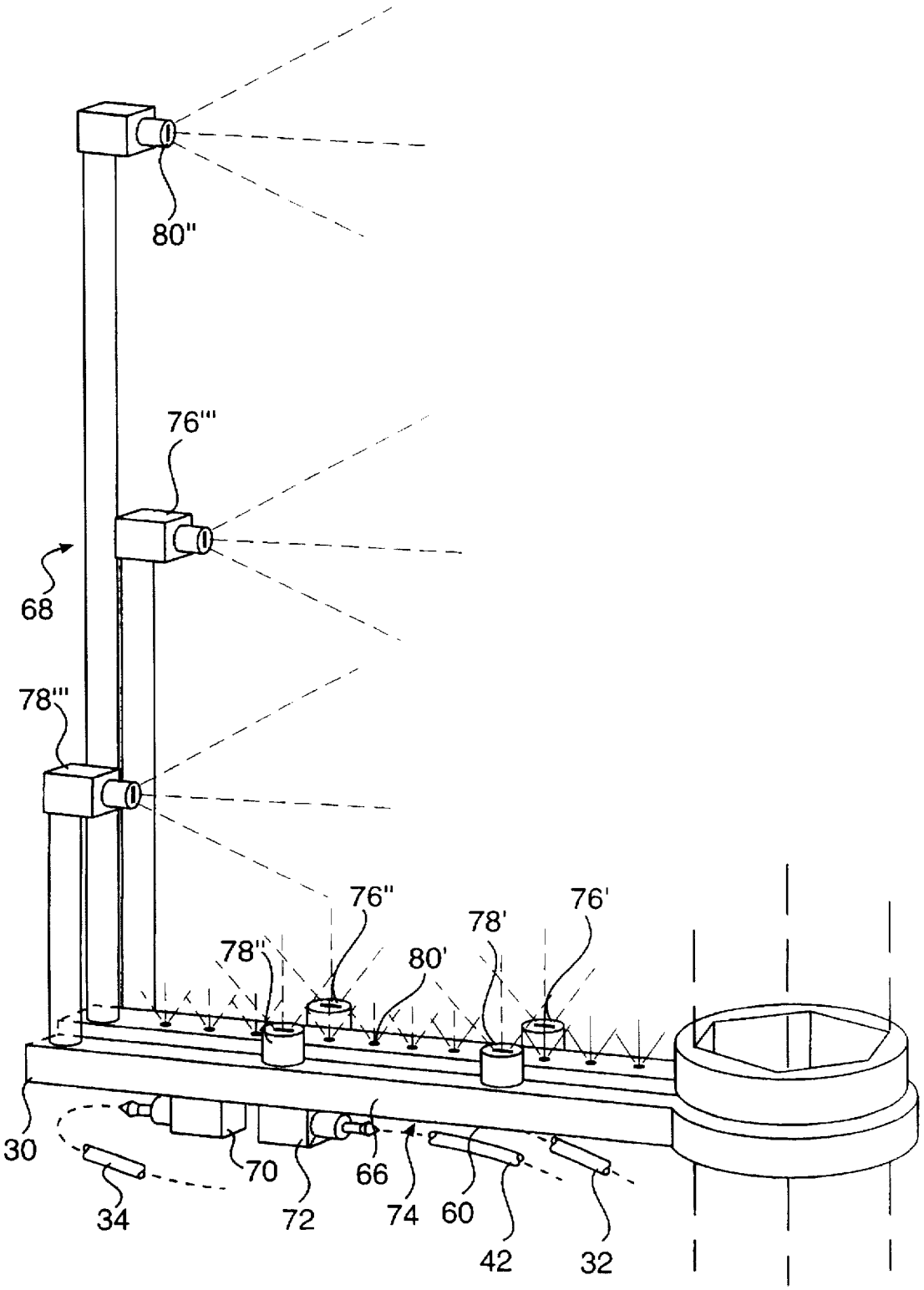
FIG. 3 shows a portion of the dishwashing assembly of the machine of FIGS. 1 and 2 carrying the spraying nozzles.
Figure 4A:
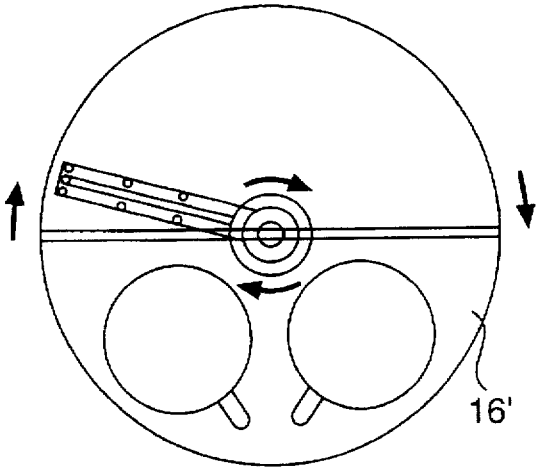
FIG. 4 is a schematic representation of the device from the same view as in FIG. 2 in three operational stages.
Figure 4B:
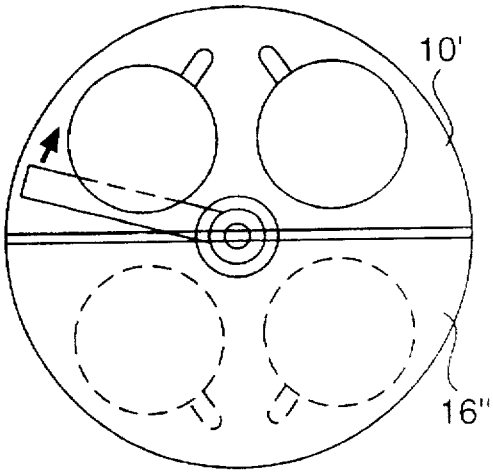
Figure 4C:
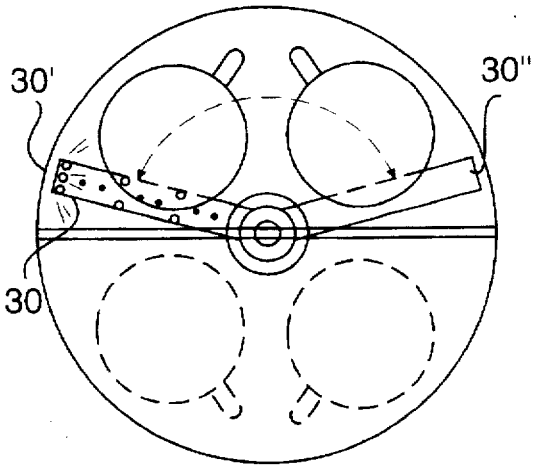
Figure 4D:
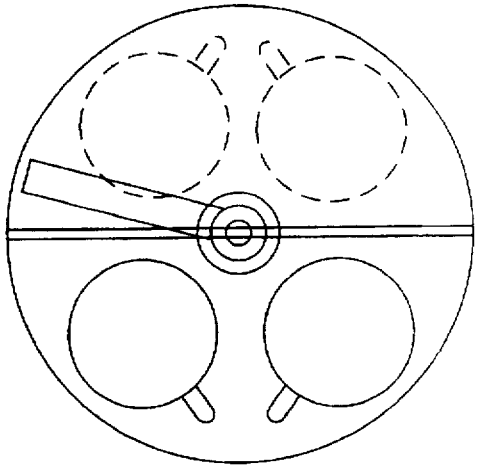

Reference is now being made to FIG. 3 giving a more detailed illustration of rotatable arm 30. Arm 30 which is generally L-shaped has a horizontal leg 66 and a vertical leg 68. Horizontal leg 66 has integral liquid passages leading from duct connectors 70, 72 and 74 (the latter not seen in the Figure) to the nozzles. Of the nozzles in arm 30 nozzles 76', 76" and 76'" belong to one detergent spraying sub-assembly and nozzles 78' 78" and 78'" belong to a second detergent spraying sub-assembly, whereas the array of plurality of nozzles 80' and nozzle 80" belong to the water dispensing sub-assembly. The nozzles on horizontal leg 66 spray the liquid upwards and the nozzles on vertical arm 68 spray the liquid sidewards with a slant; this arrangement ensures wetting of cups on the tray from both above and below. Nozzle 78'" is at a level in which it will spray its liquid to the lowermost portion of an inverted glass held on the dishwashing means which in use of the glass is the upper edge which typically receives lip stains and the like which should be removed.

The sequence of operation of the dishwasher machine is shown in FIG. 4. In the first step shown in FIG. 4(*a*), cups are placed on portion 16' of rotatable tray 16 and then after activating the machine, the tray rotates whereby the cups come to lie within the chamber as shown in FIG. 4(*b*). Cups on portion 16" which were previously cleaned within the chamber can then be removed and a new load of cups can then be placed on this portion.

After the tray rotates to the position shown in FIG. 4(*b*), there begins the sequence of washing operation represented schematically in FIG. 4(*c*). The dishwashing assembly is activated to spray water through the water dispensing sub-assembly and arm 30 is then rotated from the position 30' to the counter position 30" as shown in FIG. 4(*c*). After rotation through the chamber the water spraying is ceased and the first detergent dispensing sub-assembly is activated and the arm then rotates from the position from 30" back to the position 30'. This is then followed in a similar manner by reactivation of the water spraying in the same manner as above so as to rinse the detergent, the activation of the spraying by the second detergent dispensing sub-assembly, and then finally spraying of water and rotation of the arm again through the chamber. It should be noted that it is also possible that rather than passing through the chamber once at each step by rotation from the position 30' to 30" or vice versa, the arm may also be made to rotate several times in each step of the cycle, e.g. rotate from the position 30' to position 30" and back to position 30'.

It should be noted that rather than having the arm rotated in a manner shown in the embodiment illustrated herein, the arm may be made to move thoroughly the chamber in other manners. Furthermore, rather than having a single L-shaped arm as in the illustrated embodiment, the nozzles may be situated on two arms, e.g. two arms which rotate in parallel throughout the chamber, one from above and one from below.

It should further be noted that rather than having a rotatable arm, the nozzles may also be stationary either within a zone of said container, and the dish holding tray is thus adapted to rotate through the chamber and pass the dishes through said zone at each step of the operational cycle; or alternatively, the nozzles may be distributed throughout the washing chamber so as to be able to spray their liquid simultaneously on all dishes held within the chamber.

Figure 5:
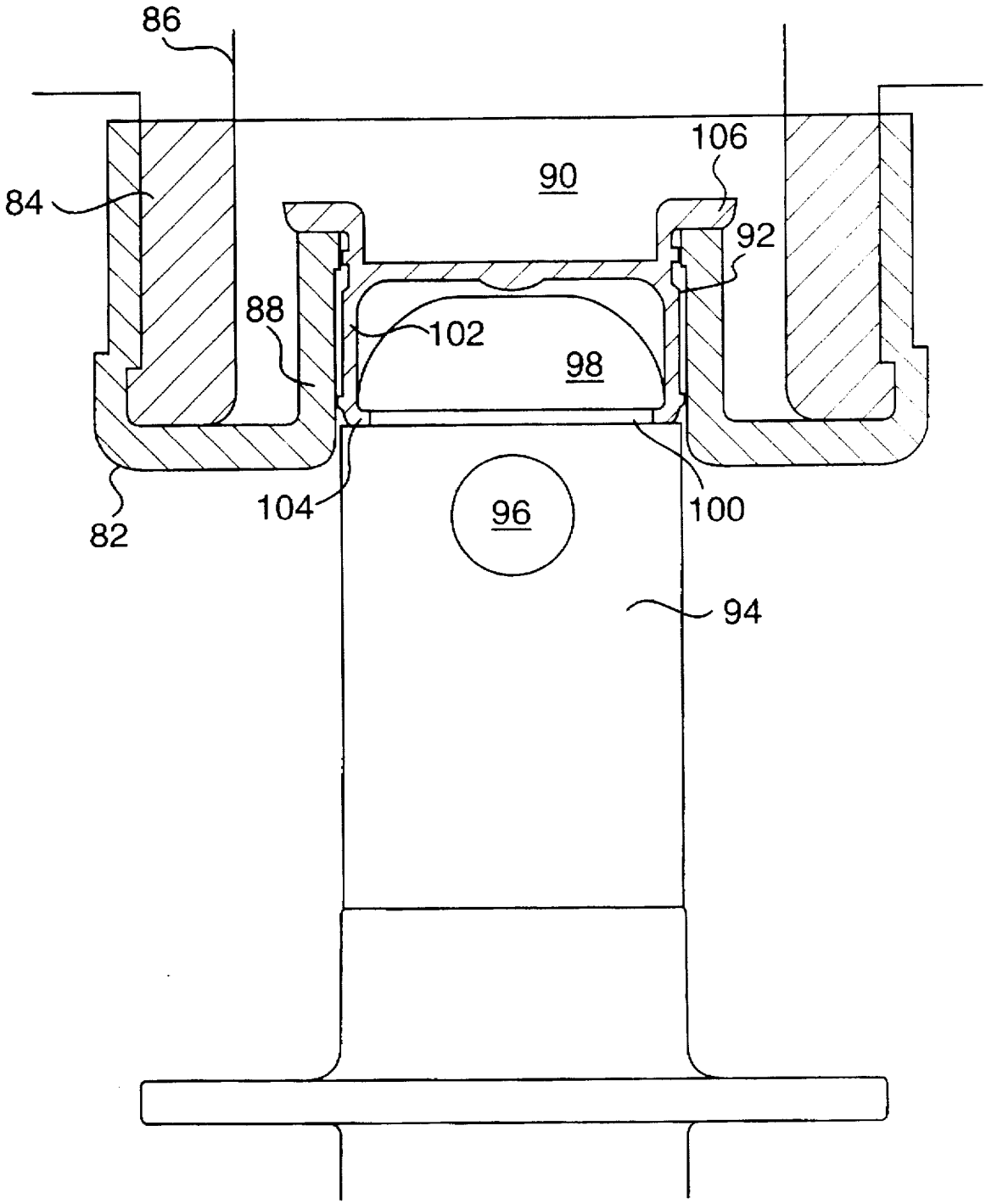
FIG. 5 shows a cap of a detergent container in a closed state and an elongated member of a detergent receiving assembly intended to cooperate therewith, in accordance with a preferred embodiment of the invention.

Reference is now being made to FIG. 5 showing a cap 82 fitted onto a neck portion 84 of an opening 86 of a detergent container (only the neck portion of the container is shown). The cap has a central cylindrical recessed portion 88 having a distal open end 90. The distal end 90 is fitted with a closure means 92. In the position shown in FIG. 3, closure means 92 seals opening 90.

Elongated member 94 forms part of a detergent receiving assembly within a dishwasher machine of the invention and has an internal passageway (not shown) leading from one or more openings 96 at its end portion to a detergent duct (also not shown). The elongated member terminates at a dome-shaped head portion 98 being defined by a groove 100.

The closure means 92 has a rearward extending cylindrical portion 102 which has an annular inward extending projecting end 104 adapted to snatch into engagement with groove 100 and has lateral annular shoulders 106. Thus, once pushed towards one another, elongated member 94 and closure means 92 come into engagement and then the latter is pushed by the former towards the interior of the container, thus causing its detachment from the cylindrical recess 88, said closure means remaining engaged in their position with said elongated member, as can be seen in FIG. 6.

Figure 6:
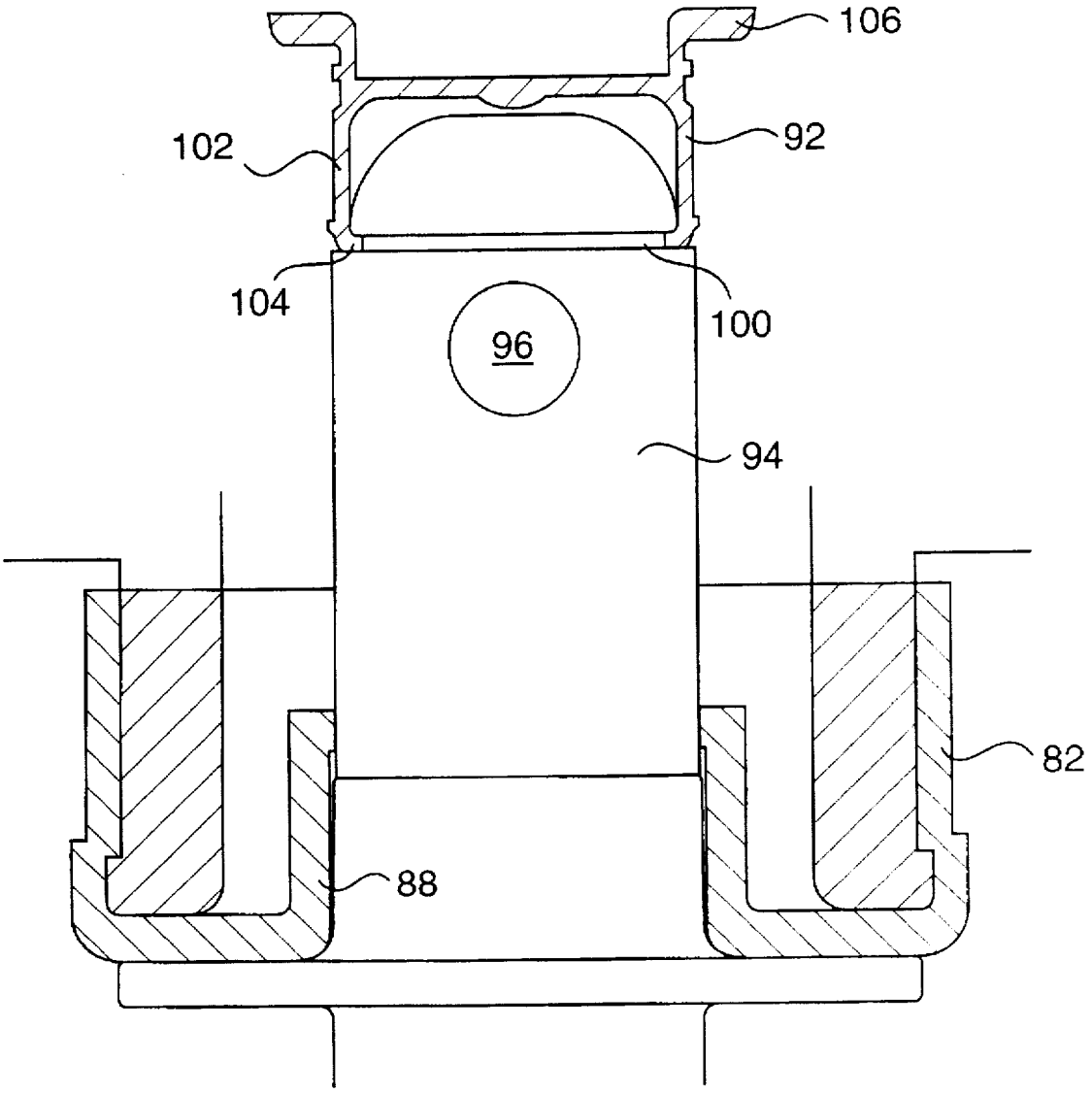
FIG. 6 shows the cap and assembly of FIG. 3 fitted together in a manner whereby detergent can be withdrawn from the container into the passageway within the elongated member.

Once engaged with one another, in the position as shown in FIG. 6, elongated member 94 extends through cap 82 so that openings 96 are within the container thus capable of drawing detergent from the container into the passageway within the elongated member (not shown). The external diameter of the elongated member 94 is essentially identical to the internal diameter of cylindrical recess 88 whereby the two sealingly associate one another.

Once the container is detached, the elongated member 94 is pulled back through the cylindrical recess 88, pulling closure means 92 with it until the latter is arrested by shoulder 106, in which position closure means 92 recloses opening 90, and the container can then be removed without any excess detergent being spilled to the surrounding.

We claim:

1. A dishwashing machine comprising:

a dishwashing chamber configured as a single dishwashing compartment, a dish holder for holding dishes within said chamber, and a dishwashing assembly for washing dishes held within said chamber;

said assembly comprises at least two liquid spraying sub-assemblies, of which at least one is a detergent spraying sub-assembly for spraying of detergent only and at least one other is a water spraying sub-assembly for spraying of water only, each of the liquid spraying sub-assemblies being activated to spray liquid in a different step of an operational cycle; each sub-assembly located within said single dishwashing compartment, each sub-assembly comprises a plurality of spray nozzles, one or more liquid ducts leading form a liquid reservoir to the nozzles, and a flow controller for rapid activation and inactivation of the spraying of liquid out of the nozzles; the nozzles of each sub-assembly being arranged so that their combined spraying will apply liquid on substantially all faces of the dishes, the nozzles being held on one or more arms moveable within the chamber, each such arm holding nozzles of all sub-assemblies, the arm being adapted to pass throughout the chamber at each of the steps of the operational cycle.

2. A dishwashing machine according to claim 1, wherein all nozzles are held on one or more arms moveable within said chamber at each step of the operational cycle, to spray the liquid sprayed in a step on all dishes held within the chamber.

3. A dishwashing machine according to claim 2, wherein movement of said arms is rotational.

4. A dishwashing machine according to claim 1, comprising three liquid spraying sub-assemblies consisting of one water spraying sub-assembly and two detergent spraying sub-assemblies.

5. A dishwashing machine comprising:

a dishwashing chamber having a single dishwashing compartment, a dish holder for holding dishes within said chamber, and a dishwashing assembly for washing dishes held within said chamber;

said assembly including a single rotatable arm being adapted to pass throughout the chamber at each step of an operational cycle and at least two liquid spraying sub-assemblies, of which at least one is a detergent spraying sub-assembly for spraying of detergent only and at least one other is a water spraying sub-assembly for spraying of water only, each of the liquid spraying sub-assemblies being activated to spray liquid in a different step of the operational cycle, each sub-assembly located within said single dishwashing compartment; each sub-assembly comprises a plurality of spray nozzles, with said spray nozzles being located on said single arm, one or more liquid ducts leading from a liquid reservoir to the nozzles, and a flow controller for rapid activation and inactivation of the spraying of liquid out of the nozzles; the nozzles of each sub-assembly being arranged so that their combined spraying will apply liquid on substantially all faces of the dishes.

6. A dishwashing machine comprising:

a dishwashing chamber configured as a single dishwashing compartment;

a dish holder for holding dishes within said chamber, said dish holder including a loading-unloading rotatable tray divided by a vertical water impermeable partition into two identical portions, the tray being positioned such that when one of the identical portions is within the dishwashing chamber, the other of said portions is outside said chamber and by rotation of the tray the positions of the portions are replaced with one another, said partition being capable of water-tight engagement with adjacent wall portions of the dishwashing chamber; and a dishwashing assembly for washing dishes held within said chamber, said assembly including at least two liquid spraying sub-assemblies, of which at least one is a detergent spraying sub-assembly for spraying of detergent only and at least one other is a water spraying sub-assembly for spraying of water only, each of the liquid spraying sub-assemblies being activated to spray liquid in a different step of an operational cycle, each sub-assembly located within said single dishwashing compartment, each sub-assembly comprises a plurality of spray nozzles, one or more liquid ducts leading form a liquid reservoir to the nozzles, and a flow controller for rapid activation and inactivation of the spraying of liquid out of the nozzles, the nozzles of each sub-assembly being arranged so that their combined spraying will apply liquid on substantially all faces of the dishes, the nozzles being either (i) stationary and spatially distributed within said chamber so as to apply their liquid simultaneously on all dishes held on the dish holder within the chamber, or (ii) being held on one or more arms moveable within the chamber, each such arm holding nozzles of all sub-assemblies, the arm being adapted to pass throughout the chamber at each of the steps of the operational cycle.

7. A dishwashing machine according to claim 6, wherein the nozzles are held on one or more rotatable arms, having an axis of rotation which is co-axial with an axis of rotation of said tray.

8. A dishwashing machine according to claim 7, comprising an L-shaped spray arm having a horizontal leg extending below the tray and a vertical leg extending above upper faces of dishes held on the tray, there being nozzles on the horizontal leg adapted for spraying liquid upwards onto lower face of the dishes and the vertical leg carrying nozzles adapted for spraying liquid sideways and/or downwards with a slant, for spraying liquid on upper faces of the dishes.

9. A dishwashing machine according to claim 6, comprising a replaceable detergent container.

10. A dishwashing machine according to claim 9, wherein the replaceable container comprises a detergent discharge opening which is adapted to cooperate with a member of the detergent receiving assembly within the dishwashing machine to allow leakage-free transfer of detergent from the container to said assembly.

11. A dishwashing machine according to claim 10, wherein the detergent receiving assembly comprises an elongated member having a lumen defining a liquid passageway leading from one or more apertures at its end portion to the detergent spraying sub-assembly; the end portion being adapted for insertion through a cap fitted on the discharge opening so that said apertures come to lie within the said container.

12. A dishwashing machine according to claim 11, wherein the cap has a central cylindrical recess with an opening at its end which is distal from the cap's external surface, the distal end being closed by a detachable closure which once detached can be reattached to said distal end thus reclosing the opening; and said elongated member being cylindrical at at least an end portion thereof with an external diameter essentially identical to the internal diameter of said cylindrical recess, and having a length to allow it to pass through said cylindrical recess so that its said one or more apertures come to lie within said container; an end portion of said elongated member being adapted for engagement with said closure; whereby once the opening of the container is fitted onto said detergent receiving assembly, said end portion engages with the closure which remains engaged with said end portion as long as the container and the detergent receiving assembly remain combined, and once the container is detached from the detergent receiving assembly, the closure is thereby pulled back to said opening and reattaches itself onto said distal end.

* * * * *